US007624931B2

(12) United States Patent
Chapman, Jr. et al.

(10) Patent No.: US 7,624,931 B2
(45) Date of Patent: Dec. 1, 2009

(54) ADJUSTABLE DISPLAY RESOLUTION FOR THERMOSTAT

(75) Inventors: John Gilman Chapman, Jr., Delaware, OH (US); Tony Gray, Dublin, OH (US)

(73) Assignee: Ranco Incorporated of Delaware, Carol Stream, IL (US)

( * ) Notice: Subject to any disclaimer, the term of this patent is extended or adjusted under 35 U.S.C. 154(b) by 616 days.

(21) Appl. No.: 11/216,763

(22) Filed: Aug. 31, 2005

(65) Prior Publication Data

US 2007/0045443 A1 Mar. 1, 2007

(51) Int. Cl.
*G05D 23/00* (2006.01)
*G05D 23/275* (2006.01)
*G06F 3/048* (2006.01)

(52) U.S. Cl. ..... 236/94; 236/91 R; 715/831

(58) Field of Classification Search ..... 236/91 R, 236/91 C, 91 F, 94; 715/830, 831, 832, 833, 715/834

See application file for complete search history.

(56) References Cited

U.S. PATENT DOCUMENTS

| | | | |
|---|---|---|---|
| 3,930,611 | A | 1/1976 | Demaray |
| 4,282,591 | A | 8/1981 | Andreuccetti |
| 4,288,990 | A | 9/1981 | Schulz |
| 4,462,540 | A | 7/1984 | Dytch |
| 4,969,508 | A | 11/1990 | Tate et al. |
| 5,082,173 | A | 1/1992 | Poehlman et al. |
| 5,271,558 | A | 12/1993 | Hampton |
| 5,272,477 | A | 12/1993 | Tashima et al. |
| 5,595,342 | A | 1/1997 | McNair et al. |
| 5,803,357 | A | 9/1998 | Lakin |
| 5,833,134 | A | 11/1998 | Ho et al. |
| 5,924,486 | A | 7/1999 | Ehlers et al. |
| 6,116,512 | A | 9/2000 | Dushane et al. |
| 6,213,404 | B1 | 4/2001 | Dushane et al. |
| 6,449,533 | B1 | 9/2002 | Mueller et al. |
| 6,513,723 | B1 | 2/2003 | Mueller et al. |
| 6,851,621 | B1 * | 2/2005 | Wacker et al. ..... 236/51 |

(Continued)

FOREIGN PATENT DOCUMENTS

JP 2000074746 A * 3/2000

(Continued)

OTHER PUBLICATIONS

Getware, website, http://web.archive.org/web/20050208033208/getware.com/g2/features/display.htm, date last visited Dec. 19, 2007.

(Continued)

*Primary Examiner*—Chen-Wen Jiang
(74) *Attorney, Agent, or Firm*—Reinhart Boerner Van Deuren, P.C.

(57) ABSTRACT

A visual display system for use with a digital thermostat is provided. The visual display system provides an adjustable display resolution for the temperature readout provided thereon. This adjustable display resolution may be changed as desired by a user via a resolution adjustment menu. The display resolution may be adjusted to display the temperature information in tenths of degrees, half degrees, whole degrees, etc. as desired by a user. Such a display system accommodates different display resolution requirements of different original equipment manufacturer (OEM) customers who may desire different displayed resolutions without having to manufacture and stock different models.

9 Claims, 3 Drawing Sheets

U.S. PATENT DOCUMENTS

| | | | | |
|---|---|---|---|---|
| 7,000,849 | B2 * | 2/2006 | Ashworth et al. | 236/94 |
| 7,302,642 | B2 * | 11/2007 | Smith et al. | 715/702 |
| 2001/0048030 | A1 | 12/2001 | Sharood et al. | |
| 2004/0133314 | A1 | 7/2004 | Ehlers et al. | |
| 2005/0040248 | A1 * | 2/2005 | Wacker et al. | 236/51 |
| 2005/0040250 | A1 * | 2/2005 | Wruck | 236/51 |
| 2005/0043907 | A1 | 2/2005 | Eckel et al. | |
| 2005/0194457 | A1 | 9/2005 | Dolan | |

FOREIGN PATENT DOCUMENTS

| | | | |
|---|---|---|---|
| WO | WO 02/05052 | A1 * | 1/2002 |

OTHER PUBLICATIONS

Theta Engineering, "Smart" Thermostat, website, date last visited Oct. 26, 2006, previously visited Oct. 27, 2005, 3 pages, http://www.thetaeng.com/SmartThermostat.htm.

* cited by examiner

ADJUSTABLE DISPLAY RESOLUTION FOR THERMOSTAT

FIELD OF THE INVENTION

The present invention relates generally to digital thermostats, and more particularly to digital thermostats that have a user interface display screen for displaying of heating, ventilating and air conditioning (HVAC) information.

BACKGROUND OF THE INVENTION

Occupants of dwellings and commercial structures have long benefited from the inclusion of a heating, ventilating, and air conditioning (HVAC) system that regulates the temperature and humidity within the dwelling or structure. Traditionally, the thermostat that controlled this temperature regulating equipment was a fairly simple electromechanical device that would allow a user to rotate a dial to a desired set point. While the resolution of the temperature information on the dial varied from model to model, it is typically not better than two degrees, and is only indicated by a moving pointer on the dial.

Advances in control electronics have allowed the development of new, digital thermostats that may be programmed by a user to control the heating and cooling equipment in a much more energy efficient manner than the older electromechanical devices. These modern digital thermostats allow programming that can automatically set back the heat, for example, during periods when the dwelling or structure is not occupied, and can turn up the heat just prior to and during periods of occupation of the dwelling or structure. Indeed, many such digital thermostats allow for different programming options during different days of the week, for example, one programmed operation during the week and a different programmed operation on the weekend, to accommodate the different usage patterns of the occupants of that particular dwelling or structure.

While the advances that are being included in modern digital thermostats greatly enhance the users' comfort level and minimize the energy usage, the overall user experience interfacing with such a digital thermostat has not kept pace. Specifically, the sophisticated electronic programming and digital display provided by such thermostats lead consumers to believe that the displayed temperature reading is highly accurate. This is because, e.g., such digital thermostats provide a temperature readout that has a displayed resolution of 0.1 degrees. However, such a thermostat, while perceived to be highly accurate due to the displayed resolution, may appear to be inaccurate when placed next to or compared with another temperature sensing device. This often creates an issue for the original equipment manufacturer (OEM) customers of thermostats who receive numerous customer complaints about the accuracy of the digital thermostat.

To alleviate these complaints, many digital thermostat manufactures have reduced the resolution of displayed temperature. However, this has lead to other complaints that such a sophisticated thermostat should be able to display finer resolution for the temperature readout. Due to cost constraints, the thermostat manufactures only provide a single resolution for the same model of thermostat, with the resolution set to the lowest desired by all customers. That is, if one OEM customer desires the resolution to be set at whole degrees, all customers get the resolution set at whole degrees. However, while addressing one problem, this solution alienates other customers who want a finer resolution to be displayed on the digital thermostat.

There exists, therefore, a need in the art for a display system for a digital thermostat that allows the display resolution to be configured by an end user.

The invention provides such a digital thermostat display system. These and other advantages of the invention, as well as additional inventive features, will be apparent from the description of the invention provided herein.

BRIEF SUMMARY OF THE INVENTION

The present invention provides a new and improved digital thermostat. More particularly, the present invention provides a new and improved digital thermostat having a display system that allows the displayed resolution of the temperature readout displayed thereon to be changed. Even more particularly, the present invention provides a new and improved display system for a digital thermostat that allows to be changed by an installer and/or end user to meet the desires and needs of that end user.

In one embodiment of the present invention, the adjustable resolution display system that allows the configuration of the display resolution at run time allows an OEM to ship units with the resolution configured to their liking, and also allows a customer to change it if they so desire. The ability to modify the display resolution can also be disabled in one embodiment to suit a particular OEM's requirements. Customers who do not care to have the finest resolution displayed can back off the resolution while the unit is installed, thus providing them with more control over their system.

In a preferred embodiment of the present invention that utilizes a menu driven digital thermostat, the display resolution may be varied by accessing a user preferences menu that includes a resolution adjustment selectable item. Preferably, the display resolution may be adjusted to display tenths of degrees, half degrees, and whole degrees on the user display screen. Other embodiments of the present invention include other display resolutions, including even or odd tenths of degrees, quarter degrees, even or odd degrees, etc. as desired by user demands.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
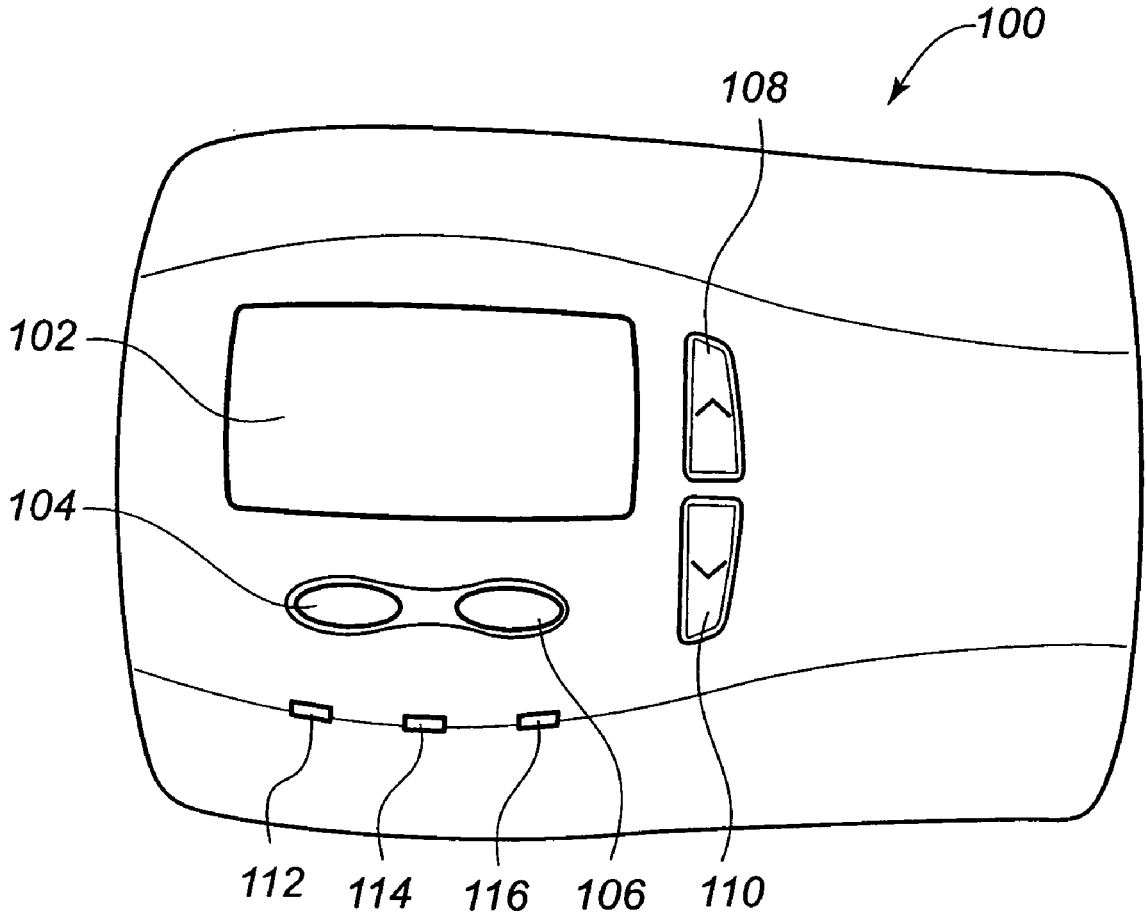
FIG. 1 is a top view illustration of an embodiment of a thermostat constructed in accordance with the teachings of the present invention.

An embodiment of a thermostat constructed in accordance with the teachings of the present invention that incorporates the display system of the present invention is illustrated in FIG. 1. As with many thermostats, an internal temperature sensor is included within the thermostat 100. As may be seen from this FIG. 1, this embodiment of the thermostat 100 includes a user display 102 on which is displayed programmatic, system, and ambient information regarding the operation of the HVAC system. This user display 102 may take various forms as are well-known in the art, and in a preferred embodiment is a dot matrix LCD display. With such a display 102, the consumer may activate various programmatic and control functions via a pair of soft keys 104, 106. The functionality executed by these soft keys 104, 106 varies dependent upon the programmatic state in which the thermostat 100 is at the time one of the soft keys 104, 106 is depressed. The particular functionality that will be instituted upon selection of one of the soft keys 104, 106 is displayed in an area of the user display 102 proximate the key 104, 106 which will institute that function. That is, the function that will be instituted upon selection of soft key 104 will be located generally in the lower left hand portion of user display 102 while the functionality that will be instituted by selection of soft key 106 will be located generally in the lower right hand portion of user display 102. These functional indicators may change depending on the program state and mode in which the thermostat is currently operating.

In addition to the soft keys 104, 106, this embodiment of the thermostat 100 of the present invention also includes adjustment keys 108, 110. These adjustment keys 108, 110 may serve to adjust a currently selected parameter up or down, such as in the case of setting the control temperature at which the thermostat will maintain the ambient environment. Additionally, these keys 108, 110 may scroll through the available data for a selected parameter, such as scrolling through alphanumeric data that may be selected for a given parameter. These keys 108, 110 may also function as soft keys depending on the programmatic state in which the thermostat is operating. When this functionality is provided, the function that will be instituted by selection of key 108 will be provided generally in the upper right hand corner of display 102, while the functionality that will be instituted by selection of key 110 will be displayed generally in the lower right hand corner of user display 102. In addition to the above, other use input means, such as an alphanumeric keypad, user rotatable knob, a touch screen, etc. may be utilized instead of the buttons 104-110 illustrated in the embodiment of FIG. 1.

In this embodiment, the thermostat 100 also includes operating mode visual indicators 112, 114, 116. These indicators 112-116 provide a visual indication of the current operating mode of the thermostat. In the embodiment illustrated in FIG. 1, indicator 112 will illuminate while the thermostat 100 is operating in the cooling mode. Indicator 116 will illuminate while the thermostat 100 is operating in the heating mode. Finally, indicator 114 will illuminate to indicate that the fan is operating. Depending on the particular application, this indicator 114 may illuminate whenever the fan is running, or may illuminate only when the fan is selected to run continuously.

In embodiments of the present invention that do not utilize automated switching control between the heating and cooling modes of operation, these indicators 112-116 may operate as user selectable switches to allow the consumer to select the operating mode of the thermostat 100. For example, during the summer months the consumer may select the cooling mode by depressing indicator 112. In this mode, the furnace will not be turned on even if the interior ambient temperature drops below the setpoint. To switch from the cooling to the heating mode of operation, the consumer, in this alternate embodiment, would need to select indicator 116 to allow the thermostat 100 to operate the furnace. Consumer selection in this embodiment of indicator 114 would operate the fan continuously, as opposed to its normal automatic operation based upon a call for cooling or heat by the thermostat 100. In a still further embodiment of the present invention, the indicators 112-116 may also be utilized to provide a visual indication of system trouble, or that there is a system reminder message being displayed on user screen 102.

Having discussed the physical structure of one embodiment of a thermostat 100 constructed in accordance with the teachings of the present invention, the discussion will now focus on the user interface temperature resolution display system which forms an aspect of the present invention. Indeed, while the following discussion will utilize the structure of the thermostat 100 illustrated in FIG. 1, those skilled in the art will recognize that various other structures can be utilized without departing from the spirit and scope of the present invention. That is, regardless of the user input mechanisms utilized by the particular embodiment of the thermostat 100 of the present invention, the programmatic steps and display information provided in the following discussion may be used.

Figure 2:
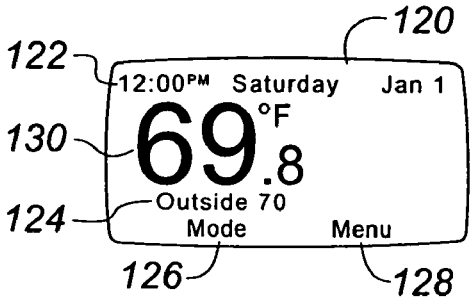
FIGS. 2-11 illustrate user display screens generated by and usable with the embodiment of the thermostat of the present invention illustrated in FIG. 1.

FIG. 2 illustrates an exemplary main display screen 120 that may be displayed on the user interface 102 of the digital thermostat 100 illustrated in FIG. 1. It should be noted, however, that the particular items illustrated in each of the screen shots discussed herein are provided by way of example only, and in no way limit the scope of the invention. Such particular menu screens are provided merely to illustrate the inventive features of the present invention in its various forms.

With this in mind, FIG. 2 illustrates a main, idle or default display screen 120 that includes various items of information that will normally be displayed on the thermostat display 102 during normal operation thereof. In this exemplary screen 120, date and time information is displayed along an upper portion 122 of the screen 120, however this information is not limiting to the scope of the invention. Similarly, this exemplary display screen 120 includes an indication of the outside temperature 124 as well as two selectable options of mode 126 and menu 128 that may be activated by selection of soft key 104 or 106 (see FIG. 1), respectively. Additional or less information may also be displayed on this default display screen 120 as desired by the manufacturer, OEM customer, and/or consumers.

Of importance to the display system of the present invention, the default display screen 120 also displays the sensed interior temperature 130. This temperature may be displayed in Fahrenheit or Celsius without departing from the spirit and scope of the present invention. As illustrated in this FIG. 2, the temperature information 130 included on screen 120 is displayed with a resolution in tenths of a degree. However, as an aspect of the present invention this display resolution may be changed.

Figure 3:
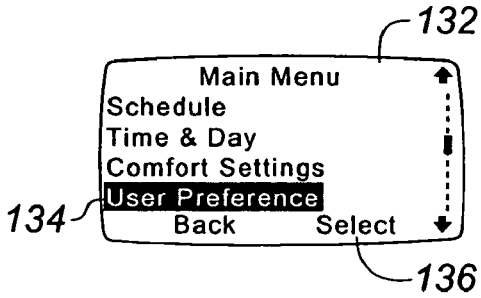
Figure 4:
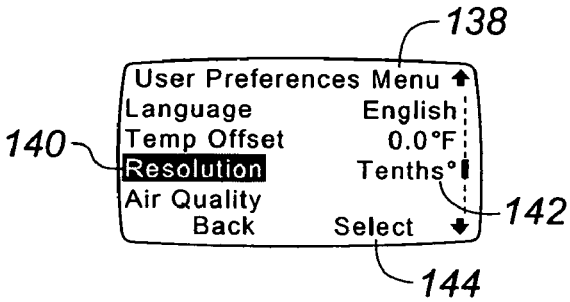

In an embodiment of the present invention wherein the digital thermostat is menu driven, the end user, OEM customer, service personnel and/or manufacturer may change the display resolution by selecting soft key 106 in proximity to the menu function 128. Upon selection of the menu functionality 128, a main menu screen 132, such as that illustrated in FIG. 3 is displayed. In the illustrated embodiment, a user would navigate the selectable items in the main menu via selection keys 108, 110 (see FIG. 1) until the user preferences item 134 is highlighted. To select the user preferences in the illustrated embodiment, the user would select soft key 106 in proximity to the select functionality 136 to pull up the user preferences menu 138 illustrated in FIG. 4.

Once the user preferences menu has been displayed, the user would navigate this menu via selection keys 108, 110 until the resolution item 140 is highlighted. As may be seen from this FIG. 4, the resolution item 140 also provides an indication of the current setting of this item, to wit tenths of degrees, at location 142.

Figure 5:
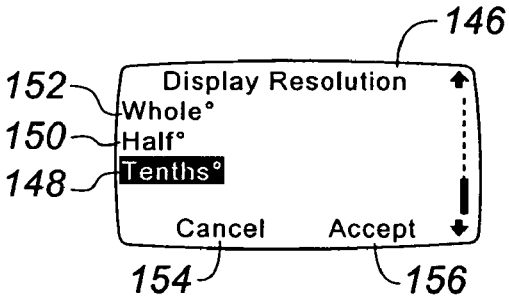

If this display resolution is desired to be changed, the user would select soft key 106 in proximity to the select functionality 144 to display the display resolution menu 146 illustrated in FIG. 5. In the illustrated exemplary embodiment, the display resolution may be set to tenths of a degree 148, half of a degree 150, or whole degrees 152. As illustrated in FIG. 5, the tenths selection 148 is highlighted, which is consistent with the displayed resolution illustrated in FIG. 2.

From this display resolution menu, the user is able, via selection keys 108, 110 in the illustrated embodiment of thermostat 100, to change the resolution of the temperature displayed on the default menu 120 of FIG. 2. If the user wishes to cancel or abort this resolution change, the user could select soft key 104 in proximity to the cancel functionality 154. If, instead, the user wishes to accept the highlighted display resolution, the user would select soft key 106 in proximity to the accept functionality 156.

Figure 6:
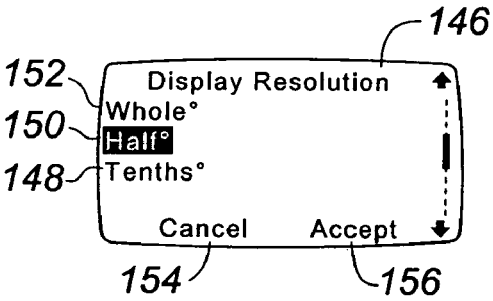
Figure 7:
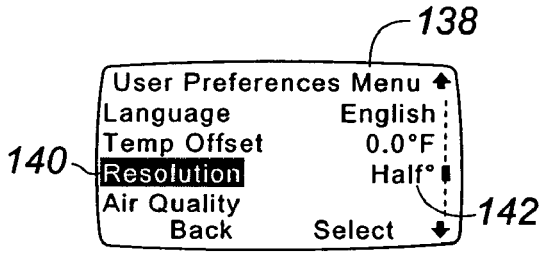

If the user were to decide to set the display resolution to half degrees, the user would select option 150 on the display resolution screen 146 as illustrated in FIG. 6. Once the half degree item 150 has been highlighted, the user would then depress soft key 106 in proximity to the accept functionality 156 to reset the display resolution to half degrees. This selection is confirmed on the user preferences menu 138 as illustrated in FIG. 7. As may be seen from this FIG. 7, the resolution item 140 now provides an indication at location 142 of the display resolution being half degrees.

Figure 8:
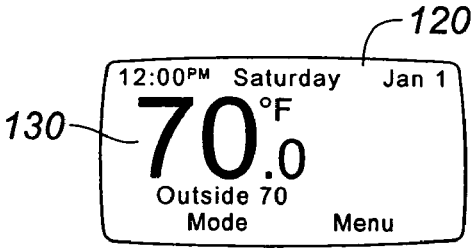

Once the display resolution has been adjusted to half degrees, the default or idle display screen 120 will appear as illustrated in FIG. 8. As may be seen, the display temperature 130 now reads 70.0 as opposed to 69.8 as it did when tenths of a degree resolution was set. With this half degree display resolution, the temperature displayed on this idle screen 120 will vary in one-half degree steps, e.g., 70.0, 70.5, 71.0, 71.5, etc. Such a resolution may be more pleasing to consumers who do not wish to see the display change for every 0.1 degree difference in temperature.

Figure 9:
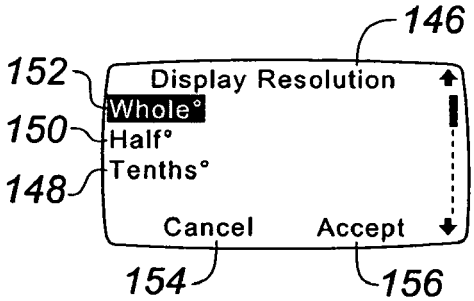
Figure 10:
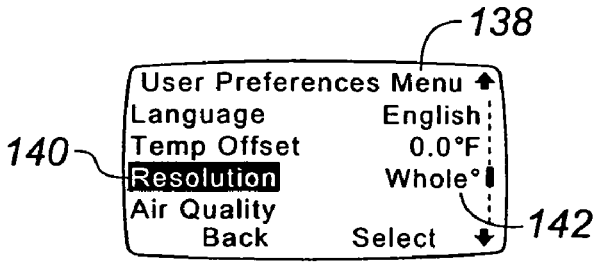

If a user were to desire the display resolution to be whole degrees, the user would simply highlight the whole degree display resolution item 152 from the display resolution menu 146 and select soft key 106 in proximity to the accept functionality 156 as illustrated in FIG. 9. The selection of the whole degree display resolution is confirmed on the user preferences menu 138 illustrated in FIG. 10, which now shows that the resolution item 140 is set to whole degrees at location 142.

Figure 11:
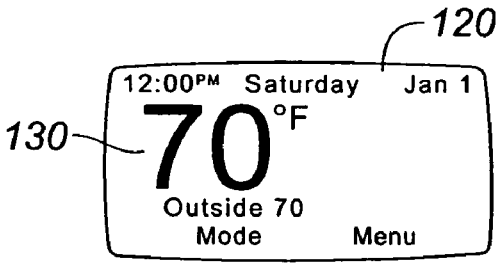

With such a whole degree temperature display resolution set, the default display screen 120 will now appear as illustrated in FIG. 11. As may be seen, the temperature display 130 simply displays a temperature of 70 without any decimal point or tenths of a degree displayed on the screen 120. With this display resolution selected, the temperature reading 130 on the default screen 120 will now vary only in whole degrees, e.g., 70, 71, 72, etc.

By allowing the configuration of the display resolution at run time, an OEM can now ship a single SKU unit with the resolution configured to their liking, and customers can change it if they so desire. This modification of the display resolution value may be disabled in one embodiment of the present invention, or may be available only to service personnel who have an access code to unlock this functionality, depending on a particular OEM's requirements. Since customers are now able to select the display resolution that they desire for their installed thermostat, they are more able to control their system, and less likely to complain of perceived inaccuracies based on a finer display resolution than they care to observe.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A digital thermostat, comprising;

a user display screen;

a temperature display screen displayed o the user displayed screen, the temperature display screen including a display of a current temperature having a user adjustable temperature display resolution; and a display resolution menu including thereon a plurality of selectable temperature display resolutions, and wherein the resolution of the display of the current temperature on the temperature display screen is dependent on which one of the plurality of selectable temperature display resolutions is selected.

2. The thermostat of claim 1, wherein the plurality of selectable temperature display resolutions comprises a tenth of a degree, a half of a degree, and a whole degree.

3. The thermostat of claim 1, wherein the display resolution menu is accessible from a user preferences menu, the user preferences menu indicating a current setting of the temperature display resolution.

4. The thermostat of claim 3, wherein the user preferences menu is accessible from a main menu having at least a user preferences selectable item provided thereon.

5. The thermostat of claim 4, wherein the main menu is accessible from the temperature display screen having at least a menu selectable item provided thereon.

6. The thermostat of claim 1, further comprising:

a user function selection means for inputting a user selection associated with a function indicated on the user display screen;

a user scrolling means for allowing a user to scroll among available items and parameters displayed on the user display screen; and wherein the display resolution menu includes an accept function in proximity to the user function selection means; and wherein activation of the user scrolling means changes which one of the selectable temperature display resolutions is highlighted; and wherein activation of the user function selection means changes the temperature display resolution to that which is highlighted at the time of activation.

7. The thermostat of claim 1, wherein the display resolution menu is accessible only to an Original Equipment Manufacturer (OEM) customer.

8. The thermostat of claim 1, wherein the display resolution menu is accessible only to service personnel.

9. A method of displaying temperature information on a digital thermostat, comprising the steps of:

displaying the temperature information using a preset display resolution;

receiving a user input requesting to change the preset display resolution;

displaying a display resolution menu having a plurality of selectable display resolutions provided thereon;

receiving a user selection of one of the plurality of selectable display resolutions; and displaying the temperature information using the one of the plurality of selectable display resolutions selected by the user.

* * * * *